US007485613B2

(12) United States Patent
Vlahakis

(10) Patent No.: US 7,485,613 B2
(45) **Date of Patent: *Feb. 3, 2009**

(54) LOW FOAMING CARPET-CLEANING DETERGENT CONCENTRATE COMPRISED OF ETHYLENE OXIDE ADDUCT AND WITHOUT PHOSPHATES

(75) Inventor: E. Van Vlahakis, Key Largo, FL (US)

(73) Assignee: Venus Laboratories, Inc., Wood Dale, IL (US)

( * ) Notice: Subject to any disclaimer, the term of this patent is extended or adjusted under 35 U.S.C. 154(b) by 64 days.

This patent is subject to a terminal disclaimer.

(21) Appl. No.: 11/070,459

(22) Filed: Mar. 1, 2005

(65) Prior Publication Data

US 2006/0116308 A1 Jun. 1, 2006

Related U.S. Application Data

(63) Continuation-in-part of application No. 11/001,518, filed on Dec. 1, 2004.

(51) Int. Cl.
*C11D 1/72* (2006.01)
*C11D 1/722* (2006.01)
*C11D 1/29* (2006.01)
*C11D 1/74* (2006.01)

(52) U.S. Cl. ..... 510/278; 510/280; 510/356; 510/358; 510/421; 510/424

(58) Field of Classification Search ..... 510/278, 510/421, 280, 356, 358, 424
See application file for complete search history.

(56) References Cited

U.S. PATENT DOCUMENTS 3,029,205 A * 4/1962 Henderson et al. ..... 510/424
3,706,672 A * 12/1972 Martin et al. ..... 510/476
3,852,209 A * 12/1974 Hofmann ..... 510/227
3,941,710 A * 3/1976 Gilbert et al. ..... 510/220
3,997,576 A 12/1976 Oghoshi et al.
4,001,132 A * 1/1977 Maguire, Jr. ..... 510/228
4,072,632 A * 2/1978 Reed ..... 510/235
4,199,482 A * 4/1980 Renaud et al. ..... 510/284
4,367,169 A 1/1983 Matsushita et al.
4,374,056 A 2/1983 Watanabe et al.
4,438,025 A 3/1984 Satsuki et al.
4,487,710 A 12/1984 Kaminsky
4,488,989 A 12/1984 Lamberti
4,597,898 A 7/1986 Vander Meer
4,705,644 A 11/1987 Barone et al.
4,919,845 A * 4/1990 Vogt et al. ..... 510/356
4,975,218 A * 12/1990 Rosser ..... 510/158
5,104,567 A 4/1992 Staehr
5,143,639 A 9/1992 Krawack
5,380,453 A 1/1995 Krawack
5,382,677 A 1/1995 Colignon et al.
5,391,783 A 2/1995 Colignon et al.
5,397,494 A 3/1995 Vega et al.
5,429,773 A 7/1995 Sherry et al.
5,475,134 A 12/1995 Baker
5,482,644 A 1/1996 Nguyen et al.
5,514,302 A * 5/1996 Brown ..... 510/280
5,534,167 A * 7/1996 Billman ..... 510/280
5,602,089 A 2/1997 Pennaz
5,616,781 A 4/1997 Sajic et al.
5,637,560 A 6/1997 Raehse et al.
5,637,758 A 6/1997 Sajic et al.
5,688,982 A 11/1997 Khan et al.
5,851,976 A 12/1998 Mertens
5,853,430 A * 12/1998 Shindo et al. ..... 8/137
5,912,223 A * 6/1999 Drapier ..... 510/417
5,945,394 A 8/1999 Sajic et al.
5,955,413 A * 9/1999 Campagna et al. ..... 510/278
5,958,861 A * 9/1999 Durbut et al. ..... 510/365
5,965,500 A 10/1999 Puvvada
5,968,885 A * 10/1999 Del Duca et al. ..... 510/375
5,968,893 A 10/1999 Manohar et al.
5,972,861 A 10/1999 Rolfes
6,008,181 A * 12/1999 Cripe et al. ..... 510/426
6,013,611 A 1/2000 Thomas et al.
RE36,593 E 2/2000 Emery
6,024,943 A * 2/2000 Ness et al. ..... 424/59
6,046,151 A 4/2000 Drapier et al.
6,057,280 A 5/2000 Huish et al.
6,060,440 A 5/2000 Sackariasen et al.
6,407,050 B1 6/2002 Huish et al.
6,468,956 B1 10/2002 Huish et al.
6,559,112 B2 * 5/2003 Fox et al. ..... 510/278

(Continued)

FOREIGN PATENT DOCUMENTS

EP 0252695 A2 * 1/1988

(Continued)

*Primary Examiner*—Lorna M Douyon
(74) *Attorney, Agent, or Firm*—McDermott Will & Emery LLP

(57) ABSTRACT

The invention is a low foaming detergent composition, especially a low foaming carpet cleaning detergent composition, for conventional carpet cleaning, or for steam-type carpet cleaning, comprising an alkylene oxide adducts, and being devoid of phosphates. Preferably, the alkylene oxide adduct is an ethylene oxide adduct. It is also preferable that the carpet cleaning detergent be devoid of caustic soda and bleach. The detergent composition may be made from a component having between 20 and 60 moles of the ethylene oxide adduct.

30 Claims, No Drawings

U.S. PATENT DOCUMENTS

| | | | | |
|---|---|---|---|---|
| 6,720,298 | B2 * | 4/2004 | Blything et al. | 510/351 |
| 6,764,989 | B1 | 7/2004 | Huish et al. | |
| 6,774,096 | B1 * | 8/2004 | Paye | 510/130 |
| 6,780,826 | B2 * | 8/2004 | Zhang et al. | 510/130 |
| 6,794,349 | B2 * | 9/2004 | Hafkamp et al. | 510/356 |
| 6,846,796 | B2 * | 1/2005 | Schmid | 510/446 |
| 2003/0045191 | A1 * | 3/2003 | Goldstein et al. | 442/96 |
| 2003/0139317 | A1 * | 7/2003 | Behler et al. | 510/421 |
| 2003/0166488 | A1 * | 9/2003 | Elsner et al. | 510/421 |
| 2003/0171247 | A1 * | 9/2003 | Meine et al. | 510/504 |

FOREIGN PATENT DOCUMENTS

| | | | |
|---|---|---|---|
| EP | 0 336 740 | B1 | 1/1995 |
| WO | WO 98/18892 | A2 * | 5/1998 |
| WO | WO 01/79414 | A1 * | 10/2001 |

* cited by examiner

LOW FOAMING CARPET-CLEANING DETERGENT CONCENTRATE COMPRISED OF ETHYLENE OXIDE ADDUCT AND WITHOUT PHOSPHATES

CROSS-REFERENCE TO RELATED APPLICATIONS

This application is a continuation-in-part of U.S. patent application Ser. No. 11/001,518, filed on Dec. 1, 2004.

FEDERALLY SPONSORED RESEARCH OR DEVELOPMENT

None.

TECHNICAL FIELD

The invention is directed to low foaming detergents comprising alkylene oxide adducts, and optionally made from oils derived from $C_{12}$-$C_{18}$-fatty acids. It is further directed to low foaming detergent compositions made from a component having between 20 and 60 moles of alkylene oxide adduct, or between 20 and 60 moles of alkylene oxide adduct per mole of $C_{12}$-$C_{18}$-fatty acids. The invention is directed to low foaming detergents that combine favorable characteristics, including low foaming, and which also provide high cleansing capabilities, and an environmentally friendly formulation.

BACKGROUND OF THE INVENTION

Detergents are well-known in the art. The detergent compositions that are currently available are suitable for their intended purposes, i.e., effectively cleaning, and leaving previously soiled fabrics, clothing, dishes, or utensils in a generally spot-free, clean condition.

Detergents can include dishwashing detergents, carpet cleaning detergents, and others. These and other detergents contain some combination of one or more of three ingredients, including bleach, caustic soda, and phosphates. These substances can be deleterious, for various reasons.

For example, phosphates are minerals that act as water softeners, and are considered by some to be among the worst pollutants found in detergents. Phosphates are a nutrient, and act as a fertilizer for algae. Thus, when phosphates enter waterways, they promote the growth of algae and other plants. In the presence of large amounts of phosphates and other similar nutrients, excessive algae growth occurs. This causes odors and creates hypoxic conditions.

Some states have banned the use of phosphates in all detergents, other than automatic dishwasher detergents. Thus, phosphate-free general purpose detergents and clothing detergents are readily available.

Caustic soda is also considered to be a contaminant of groundwater. For example, alumina plants use and discharge caustic soda into the groundwater adjacent their plants, and such groundwater contamination is considered to be a significant environmental problem. Moreover, the caustic soda can impart to an automatic dishwashing detergent a noticeable odor, which can be described as a "choking-type" odor. Moreover, an etched film can be irreversibly formed on the surface of glassware that has been repeatedly washed with automatic dishwashing detergents which contain caustic soda.

Bleach provides dishwashing detergents with some disinfecting capabilities. While bleach in groundwater is not generally deemed to be deleterious, the removal of bleach from an automatic dishwashing detergent would lower the cost of that dishwashing detergent. Bleach, especially when combined with caustic soda, can contribute to the choking-type odor that may be perceived in some other automatic dishwashing detergent products.

Dishwashing detergents are not the only kinds of detergents that exhibit certain distinctive deficiencies. Conventional carpet cleaning detergents can also exhibit certain deficiencies. In particular, conventional carpet cleaning detergents can have certain deleterious effects, and can have relatively high foaming characteristics.

First among these deficiencies, some conventional carpet cleaning detergents can have an alkaline pH. Such alkaline pH detergents can damage the mechanical parts of automatic carpet cleaning machines. In contrast, a carpet cleaning detergent with a neutral pH (7.0) would not damage the mechanical parts of such machines.

High foaming in a carpet cleaning detergent is relatively disadvantageous, as well. A "foamy" detergent will sit atop the surface of the carpet, and will thus have a tendency to not enter the sub-surface fibers of the carpet. As a result, a larger amount of such a high-foaming detergent would be necessary, in order to obtain the same results as one could obtain by using a smaller amount of a low-foaming detergent.

It would be desirable to provide detergents that are free of phosphates. It would further be desirable to provide a detergent which is free of caustic soda. Finally, it would be desirable to provide a detergent which is free of bleach.

SUMMARY OF THE INVENTION

The invention is a carpet cleaning detergent that includes alkylene oxide adducts, and is free of phosphates, caustic soda, or bleach. A carpet cleaning detergent made from a product having from 20 to 60 moles of ethylene oxide adduct is particularly effective in cleaning carpets, and is relatively low in foam formation, and in preventing damage to automatic carpet cleaning machines. Thus, preferably, the alkylene oxide adduct is an ethylene oxide adduct. One aspect of the invention is a carpet cleaning detergent made from a raw material that includes an alkylene oxide adduct, and particularly an ethylene oxide adduct. Another aspect of the invention is a carpet cleaning detergent that comprises an alkylene oxide adduct, and particularly an ethylene oxide adduct. The carpet cleaning detergent of the invention has a pH of approximately 7.0, and is thus not alkaline. The detergent of the invention is an environmentally friendly composition.

A further aspect of the invention is a carpet cleaning detergent that is further devoid of caustic soda. A still further aspect of the invention is a carpet cleaning detergent composition that is devoid of bleach.

The carpet cleaning detergent may further include a thickener, a surfactant, a water softener, a fragrance, or a filler. Preferred fillers for the liquid version of the carpet cleaning detergent include water, preferably deionized water. In contrast, sodium sulfate is the preferred filler for the dry or powdered version of the carpet cleaning detergent of the invention. A preferred fragrance is lavender oil.

Other features and advantages of the invention will be apparent from the following specification taken in conjunction with the following drawings.

DETAILED DESCRIPTION OF PREFERRED EMBODIMENT

Preferred embodiments of the invention are described below. This invention may, however, be embodied in many different forms, and should not be construed as limited to the embodiments described below. Instead, these embodiments are provided so that this disclosure will fully convey the scope of the invention to those skilled in the art.

The invention is suitable for use as a low foaming detergent. It is especially suitable for a conventional or a steam-cleaning type carpet cleaning detergent composition.

In connection with the composition of the invention, the examples below use Disponil FES 77 IS. Disponil FES 77 IS is available from Cognis Corporation, Coatings and Inks Division, Ambler, Pa. The Disponil FES 77 IS is a fatty alcohol ether sulfate, i.e., the sodium salt of a fatty alcohol ether sulfate, and in particular, an ethoxylated sodium lauryl ether sulfate. Disponil FES 77 IS includes thirty (30) moles of an ethylene oxide adduct. It is believed that for each 30 moles of this ethylene oxide adduct in Disponil FES 77 IS, there is also one mole of an oil based upon a $C_{12}$-$C_{18}$-fatty acid. The alkylene or ethylene oxide adduct acts as the hydrophilic portion of the detergent, whereas the oil based upon a $C_{12}$-$C_{18}$-fatty acid acts as the lipophilic portion of the detergent.

As noted above, Disponil FES 77 IS is said to include thirty moles of ethylene oxide adduct. The "sodium lauryl" portion of the Disponil FES 77 IS is believed to have been made using coconut oil. However, it is believed that in lieu of coconut oil, other oils, such as tallow oil, soybean oil, olive oil, and other similar oils may be used.

In order to create other carpet cleaning detergents within the scope of the invention, substitutions can be made for the Disponil FES 77 IS product. Particularly, one can substitute for the Disponil FES 77 IS a product having a greater or lesser amount of ethylene oxide adduct.

As a second example, in lieu of the Disponil FES 77 IS product, one may use Disponil FES 61 IS sodium lauryl ether sulfate, having fifty (50) moles of ethylene oxide adduct. In this case, it is believed that the ratio of alkylene oxide adduct per mole of $C_{12}$-$C_{18}$-fatty acid is 50:1.

As a third example, in lieu of the Disponil FES 77 IS product, one may use a product having up to sixty (60) moles of ethylene oxide adduct. In this case, it is believed that the ratio of alkylene oxide adduct per mole of $C_{12}$-$C_{18}$-fatty acid is 60:1.

As a fourth example, in lieu of the Disponil FES 77 IS product, one may use a product having about twenty (20) moles of ethylene oxide adduct. In this case, it is believed that the ratio of alkylene oxide adduct per mole of $C_{12}$-$C_{18}$-fatty acid is 20:1.

Products similar to Disponil FES 77 IS, but having greater or lesser amounts of ethylene oxide adduct, are also available from Cognis Corporation, Coatings and Inks Division, Ambler, Pa.

As noted above, twenty to sixty moles of ethylene oxide adduct are to be either included in the carpet cleaning detergent of the invention. Alternatively, a component of the carpet cleaning detergent in accordance with the invention includes twenty to sixty moles of ethylene oxide adduct. If significantly smaller amounts of the ethylene oxide adduct are used, the resulting carpet cleaning detergent product may foam excessively during use, as compared to the product made in accordance with the invention. If significantly greater amounts of the ethylene oxide adduct are used, the resulting carpet cleaning detergent product may not clean as effectively as product made in accordance with the invention.

The below described examples show a carpet cleaning detergent in a liquid or powder form. Alternatively, a preferred carpet cleaning detergent composition in accordance with the invention may have between 20 moles of alkylene oxide adduct and 60 moles of alkylene oxide adduct, per mole of $C_{12}$-$C_{18}$-fatty acid. A most preferred carpet cleaning detergent composition in accordance with the invention is made from a raw material having between 20 and 60 moles of ethylene oxide adduct; or from a raw material having between 20 and 60 moles of ethylene oxide adduct per mole of coconut or other oil-derived $C_{12}$-$C_{18}$-fatty acids.

The automatic carpet cleaning detergent may include preservatives. The most preferred preservative is Surcide P (hexahydro-1,3,5,-tris(2-hydroxyethyl)-s-triazine). Another suitable preservative is bronopol(2-nitro-2-bromo-1,3-propanediol). Any number of other well-known detergent preservatives may be used, as well.

In the present carpet cleaning detergents, the Disponil FES 77 IS, and the Dehypon LS-54, also both act as surfactants. Disponil FES 77 IS is preferably present in the novel carpet cleaning detergent composition in an amount of between 3% and 6% by weight.

Dehypon LS-54 is available from Cognis (Canada) Corporation, of Mississauga, Ontario, Canada. Dehypon LS-54 is preferably present in the novel carpet cleaning detergent composition in an amount of between 1% and 5% by weight. Dehypon LS-54 is believed to include five (5) moles of ethylene oxide adduct, and four (4) moles of propylene oxide adduct. Dehypon LS-54 is also believed to contain an organic $C_{12}$-$C_{14}$-component.

The Disponil FES 77 IS and the Dehypon LS-54 are believed to clean and disperse the soil on the carpets. The propylene oxide adduct portion of the Dehypon LS 54 is also believed to be especially effective in reducing the amount of foam created by the carpet cleaning detergent, during use.

Xanthan gum can be used as a thickener, especially in the liquid versions of the carpet cleaning detergent.

Corn starch may be added to either the liquid or dry, powdered forms of the carpet cleaning detergent of the invention. Corn starch has a chemical structure that is similar to the structure of starch-based food products. Because of this similarity, corn starch is especially helpful in the cleaning of such starch-based food products that may have stained or soiled a carpet. The corn starch also acts as a builder, and provides "body" to the carpet cleaning detergent.

Fillers are necessary for both the liquid and solid, powdered versions of the carpet cleaning detergents of the invention. The fillers are inactive or inert components of the carpet cleaning detergents. In the liquid version of the carpet cleaning detergent of the invention, water is the preferred filler, and deionized water is the most preferred filler. In the solid, powdered version of the carpet cleaning detergents of the invention, sodium sulfate is the preferred filler.

Water softeners are also generally added, especially in the solid, powdered version of the carpet cleaning detergent. Sodium citrate is a preferred water softener for the carpet cleaning detergent of the invention. Other Group I citrates, including potassium citrate, can also be used as a water softener.

In order to give the carpet cleaning detergent a pleasing scent, a fragrance is often added. The fragrance provides the carpet cleaning detergent with aesthetically pleasing characteristics. Lavender oil is a preferred fragrance for use with the carpet cleaning detergent in accordance with the invention.

As indicated above, the carpet cleaning detergent of the invention is devoid of bleach. Alternatively, as shown in Example 3, the sodium perborate may be an integral part of the dry, powdered detergent composition of the invention.

Sodium perborate has the chemical formula $NaBO_3$, and can be used in its anhydrous form (as shown in the preceding formula), or in one of its several hydrated forms.

The following Examples are preferred, but not limiting, embodiments of the invention. As can be seen, in using the detergent for carpet cleaning, either the liquid or dry powdered detergent concentrates of the invention are diluted with water. If a stronger detergent composition is desired, as for example for more heavily soiled carpets, the extent of dilution may be reduced, i.e., less water may be added to the liquid or powdered detergent concentrate.

EXAMPLE 1

One example of a liquid form of a carpet cleaning detergent concentrate in accordance with the invention is described below. The liquid carpet cleaning detergent of this preferred embodiment is made by blending together three separate phases. In the present example, a one-hundred pound batch is manufactured.

Phase 1 comprises deionized water and sodium citrate dihydrate. In this example, Phase 1 is made by blending 4.00 pounds of sodium citrate dihydrate USP to 42.55 pounds of deionized water. These components are mixed until the sodium citrate is completely dissolved in the water.

Phase 2 comprises three ingredients. Three (3.00) pounds of Disponsil FES IS, 0.75 pounds of xanthan gum (food grade), and 1.00 pound of Dihypon LS-54 are blended together. These three ingredients are mixed thoroughly, until all of the xanthan gum is dissolved.

After Phase 2 is properly blended as described above, Phase 2 is added to Phase 1, with agitation. Phase 1 and Phase 2 are agitated until the mix has a uniform appearance.

Phase 3 is a combination of 45.45 pounds of deionized water, 3.00 pounds of corn starch, 0.05 pound of lavender oil, and 0.200 pounds of Surcide P. All four of the ingredients of Phase 3 are combined, and then blended until the corn starch is completely dissolved.

After Phase 3 is properly blended as described above, Phase 3 is added to the combined Phase 1/Phase 2, with agitation. All three Phases are now mixed, until the entire batch has a uniform appearance.

In order to make the carpet cleaning detergent of the invention, one part (by volume) of the liquid detergent composition concentrate of this Example 1 is added to forty (40) parts (by volume) of water.

EXAMPLE 2

Described in this second example is an example of a powdered form of a carpet cleaning detergent concentrate in accordance with the invention. This preferred, powdered form of the carpet cleaning detergent of the invention is made by blending together five different components. Three of the components are solids, and two of the components are liquids.

First, the three solid components are blended. Particularly, to manufacture a one-hundred (100) pound batch of the powdered carpet cleaning detergent in accordance with the invention, four (4) pounds of sodium citrate, four (4) pounds of corn starch, and eighty-six (86) pounds of sodium sulfate are mixed thoroughly, until the mixture achieves a uniform appearance and consistency.

After the three solid components have achieved this uniform appearance and consistency to achieve a dry mix, the two liquid components are slowly added to this dry mix. The first liquid component added is five (5) pounds of Disponil FES 77 IS. The second liquid component added is one (1) pound of Dehypon LS-54. The liquid components are added slowly, so as to ensure that the liquids are completely absorbed by the three solid components.

In order to make the carpet cleaning detergent of the invention, one part (by weight) of the dry powdered concentrate of this Example 2 is added to forty (40) parts (by weight) of water.

EXAMPLE 3

Described in this third example is yet another example of a powdered form of a carpet cleaning detergent concentrate in accordance with the invention. This preferred, powdered form of the carpet cleaning detergent concentrate of the invention is made by blending together six different components. Four of the components are solids, and two of the components are liquids.

First, the four solid components are blended. Particularly, to manufacture a one-hundred (100) pound batch of the powdered carpet cleaning detergent in accordance with the invention, four (4) pounds of sodium citrate, four (4) pounds of corn starch, eighty-one (81) pounds of sodium sulfate, and five (5) pounds of sodium perborate are mixed thoroughly, until the mixture achieves a uniform appearance and consistency.

After the four solid components have achieved this uniform appearance and consistency to achieve a dry mix, the two liquid components are slowly added to this dry mix. The first liquid component added is five (5) pounds of Disponil FES 77 IS. The second liquid component added is one (1) pound of Dehypon LS-54. The liquid components are added slowly, so as to ensure that the liquids are completely absorbed by the four solid components.

In order to make the carpet cleaning detergent of the invention, one part (by weight) of the dry powdered concentrate of this Example 3 is added to forty (40) parts (by weight) of water.

EXAMPLE 4

A fourth and most preferred example of the liquid carpet cleaning detergent composition of the invention is described in this Example 4. Two phases, Phase 1 and Phase 2, are blended with a perfume to make the carpet cleaning detergent composition.

Phase 1 comprises deionized water and sodium citrate dihydrate. In this example, Phase 1 is made by blending four (4) pounds of sodium citrate dihydrate USP to 85.9 pounds of deionized water. These components are mixed until the sodium citrate is completely dissolved in the water.

Phase 2 comprises a blend of eight (8) pounds of the liquid component Disponil FES 77 IS, one (1) pound of xanthan gum (food grade), and two (2) pounds of the liquid component Dehypon LS-54 are blended together. These three ingredients are mixed thoroughly, until all of the xanthan gum is dissolved.

Phase 1 is then added to Phase 2.

To this combination, 0.1 pounds of a perfume, preferably a lavender oil, are added. Together, these components form the carpet cleaning concentrate of the invention.

In order to make the carpet cleaning detergent of the invention, one part (by volume) of the liquid detergent composition concentrate of this Example 4 is added to forty (40) parts (by volume) of water.

EXAMPLE 5

A fifth and most preferred example of the dry carpet cleaning detergent concentrate of the invention is described in this Example 5.

This preferred, powdered form of the carpet cleaning detergent concentrate of the invention is made by blending together six different components. Four of the components are solids, and two of the components are liquids.

First, the four solid components are blended. Particularly, to manufacture a one-hundred (100) pound batch of the powdered carpet cleaning detergent in accordance with the invention, four (4) pounds of sodium citrate, about 0.1 pound of a perfume, and eighty-five and nine-tenths (85.9) pounds of sodium sulfate are mixed thoroughly, until the mixture achieves a uniform appearance and consistency.

After the four solid components have achieved this uniform appearance and consistency to achieve a dry mix, the two liquid components are slowly added to this dry mix. The first liquid component added is eight (8) pounds of Disponil FES 77 IS. The second liquid component added is two (2) pounds of Dehypon LS-54. The liquid components are added slowly, so as to ensure that the liquids are completely absorbed by the four solid components.

In order to make the carpet cleaning detergent of the invention, one part (by weight) of the dry powdered concentrate of this Example 5 is added to forty (40) parts (by weight) of water.

EXAMPLE 6

A sixth example of the dry carpet cleaning detergent concentrate of the invention is described in this Example 6.

This preferred, powdered form of the carpet cleaning detergent concentrate of the invention is made by blending together six different components. Four of the components are solids, and two of the components are liquids.

First, the four solid components are blended. Particularly, to manufacture a one-hundred (100) pound batch of the powdered carpet cleaning detergent in accordance with the invention, four (4) pounds of sodium citrate, about 0.1 pound of a perfume, and seventy-five and nine-tenths (75.9) pounds of sodium sulfate are mixed thoroughly, until the mixture achieves a uniform appearance and consistency.

After the four solid components have achieved this uniform appearance and consistency to achieve a dry mix, the two liquid components are slowly added to this dry mix. The first liquid component added is sixteen (16) pounds of Disponil FES 77 IS. The second liquid component added is four (4) pounds of Dehypon LS-54. The liquid components are added slowly, so as to ensure that the liquids are completely absorbed by the four solid components.

In order to make the carpet cleaning detergent of the invention, one part (by weight) of the dry powdered concentrate of this Example 5 is added to forty (40) parts (by weight) of water.

EXAMPLE 7

A seventh example of the dry carpet cleaning detergent concentrate of the invention is described in this Example 7.

This preferred, powdered form of the carpet cleaning detergent concentrate of the invention is made by blending together six different components. Four of the components are solids, and two of the components are liquids.

First, the four solid components are blended. Particularly, to manufacture a one-hundred (100) pound batch of the powdered carpet cleaning detergent in accordance with the invention, four (4) pounds of sodium citrate, about 0.1 pound of a perfume, and ninety and nine-tenths (90.9) pounds of sodium sulfate are mixed thoroughly, until the mixture achieves a uniform appearance and consistency.

After the four solid components have achieved this uniform appearance and consistency to achieve a dry mix, the two liquid components are slowly added to this dry mix. The first liquid component added is four (4) pounds of Disponil FES 77 IS. The second liquid component added is one (1) pound of Dehypon LS-54. The liquid components are added slowly, so as to ensure that the liquids are completely absorbed by the solid components.

In order to make the carpet cleaning detergent of the invention, one part (by weight) of the dry powdered concentrate of this Example 7 is added to forty (40) parts (by weight) of water.

What is claimed is:

1. A low-foaming carpet cleaning composition having a pH of approximately 7.0 consisting of a first component having between 20 and 60 moles of an alkylene oxide adduct; a second component having a propylene oxide adduct; a filler; and optionally: a thickener, a water softener, and a fragrance, said carpet cleaning composition being devoid of phosphates.

2. The carpet cleaning detergent composition of claim 1, wherein said alkylene oxide is an ethylene oxide.

3. The carpet cleaning composition of claim 1, wherein the thickener is present in the carpet cleaning composition.

4. The carpet cleaning composition of claim 1, wherein the water softener is present in the carpet cleaning composition.

5. The carpet cleaning composition of claim 1, wherein the fragrance is present in the carpet cleaning composition.

6. The carpet cleaning composition of claim 1, wherein said filler is water.

7. The carpet cleaning composition of claim 1, wherein said filler is sodium sulfate.

8. The carpet cleaning composition of claim 5, wherein said fragrance is lavender oil.

9. A low-foaming carpet cleaning composition having a pH of approximately 7.0, consisting of a first component having between 20 and 60 moles of an alkylene oxide adduct; a second component having a propylene oxide adduct; a filler; a water softener; and optionally: a thickener, and a fragrance, said carpet cleaning composition being devoid of phosphates.

10. The carpet cleaning composition of claim 9, wherein said alkylene oxide is an ethylene oxide.

11. A low foaming composition consisting of between 3 wt. % and 16 wt. % of a first component having between 20 and 60 moles of an alkylene oxide adduct; between 1 wt. % and 5 wt. % of a second component having a propylene oxide adduct; a filler; and optionally: a thickener, a water softener, and a fragrance, said low foaming composition being devoid of phosphates.

12. The low foaming composition of claim 11, wherein said alkylene oxide is an ethylene oxide.

13. The low foaming composition of claim 11, wherein the thickener is present in the low foaming composition.

14. The low foaming composition of claim 11, wherein the water softener is present in the low foaming composition.

15. The low foaming composition of claim 11, wherein the fragrance is present in the low foaming composition.

16. The low foaming composition of claim 11, wherein said filler is water.

17. The low foaming composition of claim 11, wherein said composition has a pH of approximately 7.0.

18. A low-foaming carpet cleaning concentrate consisting of 3% by weight to 16% by weight of a first component having between 20 and 60 moles of an alkylene oxide adduct; 1% by weight to about 4% by weight of a second component having a propylene oxide adduct and optionally an ethylene oxide adduct; a filler; and optionally: a thickener, a water softener, and a fragrance, said carpet cleaning concentrate being devoid of phosphates.

19. The carpet cleaning concentrate of claim 18, wherein said alkylene oxide of said first component is an ethylene oxide adduct.

20. The carpet cleaning concentrate of claim 18, wherein the fragrance is present in the carpet cleaning concentrate.

21. The carpet cleaning concentrate of claim 18, wherein said filler is water.

22. The carpet cleaning concentrate of claim 18, wherein said filler is sodium sulfate.

23. The carpet cleaning concentrate of claim 20, wherein said fragrance is lavender oil.

24. The carpet cleaning concentrate of claim 18, wherein said first component is a fatty alcohol ether sulfate.

25. The carpet cleaning concentrate of claim 18, wherein said concentrate is added to water to form a carpet cleaning composition.

26. The carpet cleaning concentrate of claim 18, wherein said second component has an ethylene oxide adduct and a propylene oxide adduct.

27. The carpet cleaning concentrate of claim 18, wherein said second component has 5 moles of an ethylene oxide adduct and 4 moles of a propylene oxide adduct.

28. The carpet cleaning concentrate of claim 18, wherein said concentrate has a pH of approximately 7.0.

29. A carpet cleaning composition consisting of 1 part by weight of the carpet cleaning concentrate of claim 18 and 40 parts by weight of water.

30. A low-foaming carpet cleaning composition having a pH of approximately 7.0 consisting of a first component having an alkylene oxide adduct; a second component having a propylene oxide adduct; a filler; sodium perborate; and optionally: a thickener, a water softener, and a fragrance, said carpet cleaning composition being devoid of phosphates.

* * * * *